US005397405A

United States Patent [19]

Smith et al.

[11] Patent Number: 5,397,405

[45] Date of Patent: Mar. 14, 1995

[54] EXPLOSIVE COMPOSITION COMPRISING WASTE OIL, AMMONIUM NITRATE AND LIGNITE

[75] Inventors: Sydney O. Smith; Louis C. D. Kerpan, both of Fort St. John, Canada

[73] Assignee: Peace Recovery Systems Ltd., Fort St. John, Canada

[21] Appl. No.: 41,260

[22] Filed: Apr. 1, 1993

[30] Foreign Application Priority Data

Apr. 1, 1992 [CA] Canada ..... 2064609

[51] Int. Cl.[6] ..... C06B 31/28

[52] U.S. Cl. ..... 149/46; 149/124; 588/202

[58] Field of Search ..... 149/46, 60, 124; 588/202

[56] References Cited

U.S. PATENT DOCUMENTS 3,540,953 11/1970 Schulze et al. ..... 149/2
4,448,619 5/1984 Mitchell ..... 149/21

OTHER PUBLICATIONS

Hawley, *The Condensed Chemical Dictionary* 9th ed., Van Nostrand Reinhold Co., New York 1977, p. 214.

*Primary Examiner*—Donald P. Walsh
*Assistant Examiner*—Anthony R. Chi
*Attorney, Agent, or Firm*—Burke-Robertson

[57] ABSTRACT

An explosive composition for mining operations has been produced using waste oil, lignite and ammonium nitrate in selected ranges of concentrations.

8 Claims, No Drawings

EXPLOSIVE COMPOSITION COMPRISING WASTE OIL, AMMONIUM NITRATE AND LIGNITE

FIELD OF THE INVENTION

The present invention relates to blasting agent compositions.

BACKGROUND OF THE INVENTION

It has been known for sometime that explosive reactions may be initiated by an oxidizer supplying oxygen to hydrocarbon compounds, thus producing gases that will create shock waves. The oxygen balance is crucial to such reaction as one wants to ensure that all the carbon and hydrogen elements are oxidized respectively to carbon dioxide and water.

Explosive compositions containing C, H, N and O generally exhibit a maximum oxidation energy for slightly negative oxygen balance. From this standpoint blasting agent compositions of the ammonium nitrate/fuel oil (AN-OF) type have been and are widely used in commercial blasting operations. Fuel oil is commonly used in blasting agent compositions, although in some compositions, diesel fuel oil may be utilized. The explosive reaction is extremeley sensitive to water and its presence may deter or deaden the blast. In fact a major concern is to find an explosive composition with a long term storage ability, and with a good moisture resistance so as to prevent the decomposition of the oxidizing agent. While such results have been attained for some blasting agent compositions comprising fuel oil, this is not the case when diesel fuel oil is used.

Hence it is an object of the invention to provide a blasting agent composition that eliminates such problems encountered with diesel fuel, and one that is less expensive than a conventional blasting composition and that enables recycling of a used oil.

DESCRIPTION OF THE INVENTION

In accordance with the present invention there is provided an explosive composition for mining operations which comprises:

from about 4.5% to about 6.5% by weight of the total weight of waste oil; and from about 93% to about 95% by weight of the total weight of ammonium nitrate; and about 0.5% by weight of the total weight of lignite. It is preferred that the waste oil be selected, according to the definition adopted in the Province of British Columbia as Environment Special Waste Regulation O.C. 268/88, from the group consisting of automotive oil, lubricating oil, cutting oil, fuel oil, gear oil, hydraulic oil and any other refined petroleum based oil or synthetic oil which has lost its original properties through its use due to the presence of impurities, and that the ammonium nitrate be in the commercially available form of prill that is as solid particles consisting essentially of cellular, spherical aggregations of micro crystals.

The present invention produces an explosive composition that incorporates waste oil, which by its nature contains traces of metals and thus eliminates the need to add metal as it was often done to conventional ANFO type compositions. Further, the presence of lignite provides a high concentration in carbon, sulphur and hydrogen thus increasing the presence of gases such as methane ($CH_4$) and accordingly the blasting effect. The lignite is in the form of concentrated bituminous coal powder.

The waste oil by its high content in metal impurities appears to be more able to form water in oil emulsions thus retaining the water and preventing a decrease in the efficiency of the blast.

Waste oil in the form of stock tank oil containing the following metallic impurities:

| | |
|---|---|
| arsenic mg/l | <2.0 |
| Cadmium mg/l | <0.01 |
| Zinc mg/l | 758 |
| Chromium mg/l | 1.0 |
| Lead mg/l | 274 |

was used, in one experimental blasting composition according to the present invention and produced satisfactory results.

The explosive composition comprised about 94% by weight ammonium nitrate (prill), about 5.5% by weight stock tank oil and about 0.5% by weight lignite.

Hence from the standpoint of the above experiments, it follows that changes in the composition of metallic impurities and in the waste oil, together with the addition of other metals or additives such as sensitizers are within the ambit of the present invention.

Thus it is apparent that there has been provided in accordance with the invention an explosive composition that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What We Claim As Our Invention:

1. An explosive composition for mining operations comprising:

(i) from about 4.5% to about 6.5% by weight of the total weight of waste oil; and (ii) from about 93% to about 95% by weight of the total weight of ammonium nitrate; and (iii) about 0.5% by weight of the total weight of lignite.

2. An explosive composition according to claim 1 comprising a mixture of:

(i) about 94% by weight of the total weight of ammonium nitrate;

(ii) about 5.5% by weight of the total weight of waste oil;

0.5% by weight of the total weight of lignite.

3. An explosive composition according to claim 1 wherein waste oil is selected from the group consisting of waste lubrication oil, waste cutting oil, waste fuel oil, waste hydraulic oil and waste oil originating from any other refined petroleum based oil or synthetic oil.

4. An explosive composition according to claim 2 wherein waste oil is selected from the group consisting of waste lubrication oil, waste cutting oil, waste fuel oil, waste hydraulic oil and waste oil originating from any other refined petroleum based oil or synthetic oil.

5. An explosive composition according to claim 1 wherein the ammonium nitrate is in the form of prill.

6. A method of disposal of waste oil comprising exploding an explosive composition in accordance with claim 1.

7. A method according to claim 6 wherein the waste oil is selected from the group consisting of waste lubrication oil, waste cutting oil, waste fuel oil, waste hydraulic oil and waste oil originating from any other refined petroleum based oil or synthetic oil.

8. A method according to claim 7 wherein the waste oil used is in accordance with environmental regulations.

* * * * *